US008439650B2

(12) United States Patent
Beez et al.

(10) Patent No.: US 8,439,650 B2
(45) Date of Patent: May 14, 2013

(54) FLOW-CONTROLLABLE CELL PUMP WITH PIVOTABLE CONTROL SLIDE VALVE

(75) Inventors: Günther Beez, Masserberg (DE); Marco Kirchner, Auengrund (DE)

(73) Assignee: Mahle International GmbH (DE)

( * ) Notice: Subject to any disclaimer, the term of this patent is extended or adjusted under 35 U.S.C. 154(b) by 187 days.

(21) Appl. No.: 12/685,896

(22) Filed: Jan. 12, 2010

(65) Prior Publication Data

US 2010/0266434 A1 Oct. 21, 2010

(30) Foreign Application Priority Data

Jan. 13, 2009 (DE) ..... 10 2009 004 456

(51) Int. Cl.
*F04B 49/00* (2006.01)

(52) U.S. Cl.
USPC ..... 417/220; 418/241

(58) Field of Classification Search ..... 417/220; 418/26, 418/27, 28, 29, 30, 241
See application file for complete search history.

(56) References Cited

U.S. PATENT DOCUMENTS

| | | | | |
|---|---|---|---|---|
| 2,142,275 | A * | 1/1939 | Lane | 418/26 |
| 2,952,215 | A * | 9/1960 | Deschamps | 418/26 |
| 3,272,139 | A * | 9/1966 | Rosaen | 418/26 |
| 4,531,893 | A | 7/1985 | Okoh et al. | |
| 5,222,886 | A * | 6/1993 | Fischer et al. | 418/133 |
| 7,438,543 | B2 * | 10/2008 | Beez | 418/172 |
| 7,794,217 | B2 * | 9/2010 | Williamson et al. | 418/26 |
| 7,798,790 | B2 * | 9/2010 | Lutoslawski et al. | 418/26 |
| 7,931,450 | B2 * | 4/2011 | Ueki et al. | 417/220 |
| 8,057,201 | B2 * | 11/2011 | Shulver et al. | 418/26 |
| 8,079,826 | B2 * | 12/2011 | Shulver et al. | 417/220 |
| 2006/0191360 | A1 * | 8/2006 | Beez | 74/25 |
| 2007/0224067 | A1 * | 9/2007 | Arnold et al. | 418/26 |
| 2008/0175724 | A1 * | 7/2008 | Shulver et al. | 417/218 |
| 2011/0300015 | A1 * | 12/2011 | Kirchner et al. | 418/229 |

FOREIGN PATENT DOCUMENTS

| | | | |
|---|---|---|---|
| DE | 3334919 | A1 | 3/1984 |
| DE | 3446603 | A1 | 7/1985 |
| DE | 4442083 | A1 | 6/1995 |
| DE | 102006061326 | A1 | 7/2008 |
| EP | 1225337 | A2 | 7/2002 |

OTHER PUBLICATIONS

English Abstract provided for DE4442083.
English Abstract provided for EP 1225337.
English Abstract provided for DE 102006061326.
English abstract for DE-3446603.

* cited by examiner

*Primary Examiner* — Peter J Bertheaud
*Assistant Examiner* — Christopher Maxey
(74) *Attorney, Agent, or Firm* — Rader, Fishman & Grauer PLLC

(57) ABSTRACT

A flow-controllable cell pump having a bearing element that may be positioned in a receiving shell of a pump housing such that the receiving shell may assume an operational connection with at least one of a bearing element, a pump chamber positioned between an inner rotor and a control slide valve. An outer rotor may be configured in the control slide valve, and suction kidneys may be arranged on both sides of the pump chambers in the pump housing. At least one pressure kidney may be offset on both sides of the pump chambers in the pump housing. The pressure kidney may be connected with a pressure connection socket, with a control slide valve arm configured on the control slide valve.

14 Claims, 5 Drawing Sheets

FLOW-CONTROLLABLE CELL PUMP WITH PIVOTABLE CONTROL SLIDE VALVE

CROSS-REFERENCES TO RELATED APPLICATION

This application claims priority to German patent application DE 10 2009 004 456.6 filed on Jan. 13, 2009, which is hereby incorporated by reference in its entirety.

TECHNICAL FIELD

The invention relates to flow-controllable cell pump with pivotable control slide valve for the delivery of liquids such as for example water, fuels or oil, more preferably however for the lubricating oil supply of a combustion engine.

BACKGROUND

A wide range of designs of flow-controllable cell pumps with pivotable control slide valves such as for example flow-controllable vane cells pumps or also flow-controllable pendulum slide valve machines are pre-described in the prior art.

For example DE 44 42 083 C2 describes a vane cell pump with variable delivery output with a hinge pin/bolt mounted in the front and the rear cover about which the control slide valve is mounted in a pivotable manner.

In the covers of this flow-controllable cell pump on both sides of the rotor a suction kidney on the one side and offset from the latter by 180° a pressure kidney is arranged on the other side. A defined inflow from the suction connection in the suction kidneys as well as a defined discharge of the pump volumetric flow from the pressure kidneys into the pressure connection is guaranteed through connecting channels which are provided in the covers, i.e. cast in the covers mostly manufactured of aluminium casting.

The manufacture of these covers with integrated connecting channels is very production-intensive and consequently also very high-cost.

Added to this in the manufacture of the covers of aluminium casting, wherein for smaller series mostly the sand casting method is employed (a production-intensive and consequently also very high-cost method) is employed, that these connecting channels produced by the sand casting method possess an increased surface roughness due to the manufacturing method.

This increased surface roughness of the connecting channels inaccessible for effective reworking then when used in operation brings about increased flow and efficiency losses as a matter of course.

A further disadvantage of these designs when used for the lubricating oil supply of a combustion engine also consists in that in the upper rotational speed range, vibrations occur on the control slide valve, which subsequently cause pressure pulsations.

On the part of the inventor, a plurality of controllable cell pumps meanwhile proven in practice and likewise provided with a pivotable control slide valve have been presented. Mostly in the design of pendulum slide valve machines.

For example EP 1 225 337 B1 describes a flow-controllable cell pump likewise provided with a control slide valve, wherein the control slide valve is pivotably mounted in the pump housing either by means of a bearing bolt arranged in the housing or by means of a bearing eye moulded on to the control slide valve, which becomes operationally connected with a guide ring groove arranged in the housing.

With these solutions, the connecting channels are mostly arranged directly in the control slide valve, i.e. either directly in the bearing eye or near the bearing seat of the bearing bolt in the control slide valve.

Such designs wherein connecting channels are directly arranged in the control slide valve are highly suitable for larger lot sizes since the connecting channels, which are complicated to manufacture and are arranged between the two sides of the cell pump in the pump housing, fall away.

A disadvantage also of these aforementioned solutions results from the space required for these solutions in order to guarantee the stability of the individual assemblies of the pumps in the operating state.

Here, the permissible surface pressure on the bearing seat greatly restricts both the dimensioning of the bearing as well as the selection of the material for the control slide valve.

From DE 33 34 919 C2 a further possibility of mounting a pivotable control slide valve has become known.

Here, on both the control slide valve as well as in the pump housing a ball guide each or a bearing shell for accommodating (i.e. between the ball guide/bearing shell of the control slide valve and the ball guide/bearing shell of the pump housing) an associated bearing ball (or as already explained an associated bearing bolt) is arranged.

The region between the housing and the control slide valve is sealed through spring-loaded sealing bolts as presented in DE 33 34 919 C2, so that there can be flow around the region surrounding the bearing ball or the bearing bolt.

The arrangement of such spring-loaded sealing bolts between the housing and the control slide valve however is likewise highly production-intensive and high-cost, wherein however when using a bearing ball the dimensioning of the associated bearing and also the selection of the material for the control slide valve is severely restricted.

In DE 10 2006 061 326 a pivotable mounting of a control slide valve in the pump housing is pre-described among other things on the part of the inventor of the solution present here, wherein on the control slide valve as well as in the pump housing a bearing shell each for the joint accommodation of an associated bearing bolt is arranged.

Near the bearing shell of the bearing bolt a through-flow opening/connecting channel is arranged in the control slide valve (as is usual in the prior art).

This connecting channel arranged near the bearing seat of the bearing bolt in the control slide valve in this case can be optimally sealed by the control slide valve proper, but results in that the size of the pump is increased as a matter of course through the need for the connecting channel. With all aforementioned pumps unavoidable running noises currently occur in the operating state which are the result of the force vector from the drive power of the pump always being directed at the fulcrum/the bearing bolt so that the pressure peaks which result from the emptying of the individual cells lead to these pressure peaks being transmitted as vibrations via the bearing bolt to the housing and are thus also perceived acoustically.

SUMMARY

The invention is therefore based on the object of developing a flow-controllable cell pump with pivotable control slide valve which removes the disadvantages of the prior art and even in large series can be produced cost-effectively with minimum manufacturing and assembly expenditure and additionally with minimum space, i.e. also with minimum weight and minimized material use for slide valve and housing while operating with substantially less noise compared with the pumps of the prior art, in operation, also minimises the vibrations on the control slide valve caused by pressure pulsations, additionally operates almost without wear, is sturdy and not susceptible to malfunctioning while making possible high pump efficiency and is simultaneously characterized by high stability of the individual assemblies, so that within the scope of the production of the solution according to the invention, control slide valves that can be very cost-effectively produced, even of plastic material, can be employed.

According to the invention this object is solved through a flow-controllable cell pump with pivotable control slide valve according to the features of the main claim of the invention. Advantageous embodiments, details and also additional features of the invention are obtained from the subclaims and the following description of the exemplary embodiment according to the invention in conjunction with the drawings for the solution according to the invention.

BRIEF DESCRIPTION OF THE DRAWING

According to the invention this object is solved through a flow-controllable cell pump with pivotable control slide valve according to the features in one exemplary approach of a flow-controllable cell pump comprising: a drive shaft mounted in a pump housing; an inner rotor configured on the drive shaft; a bearing lug configured on a control slide valve, such that a bearing shell is configured in the bearing lug; a bearing element is configured in said bearing shell; a receiving shell, wherein the bearing element is received in the receiving shell of the pump housing such that the receiving shell is configured to assume an operational connection with at least one of the bearing element, pump chambers configured between the inner rotor and the control slide valve, and wherein an outer rotor is configured in the control slide valve, and suction kidneys arranged on both sides of the pump chambers in the pump housing connected with a suction connection socket; and at least one pressure kidney is configured on at least one side of the pump chambers in the pump housing such that the pressure kidney is connected with a pressure connection socket, with a control slide valve arm configured on the control slide valve, wherein at least one working spring is configured between the pump housing and the control slide valve arm, such that the control slide valve arm biases the control slide valve into a position of maximum rate of delivery, with at least one control pressure chamber configured between the pump housing and the control slide valve, such that the bearing element is a bearing sleeve with a through-flow opening, wherein on at least one side of the through-flow opening at least one flow-through chamber is configured in at least one of the pump housing and in the pump housing lid, which is arranged opposite the pump housing, and wherein the flow-through chamber is directly connected with the pressure kidney, which is configured on the same side of the control slide valve, however the flow-through chamber is sealed against the suction kidney that is configured on the suction side through adjacent assemblies. Of course, the claims set out the metes and bounds of the invention and are not limited to the teaching of the specification.

Here it shows.

DETAILED DESCRIPTION

Figure 1:
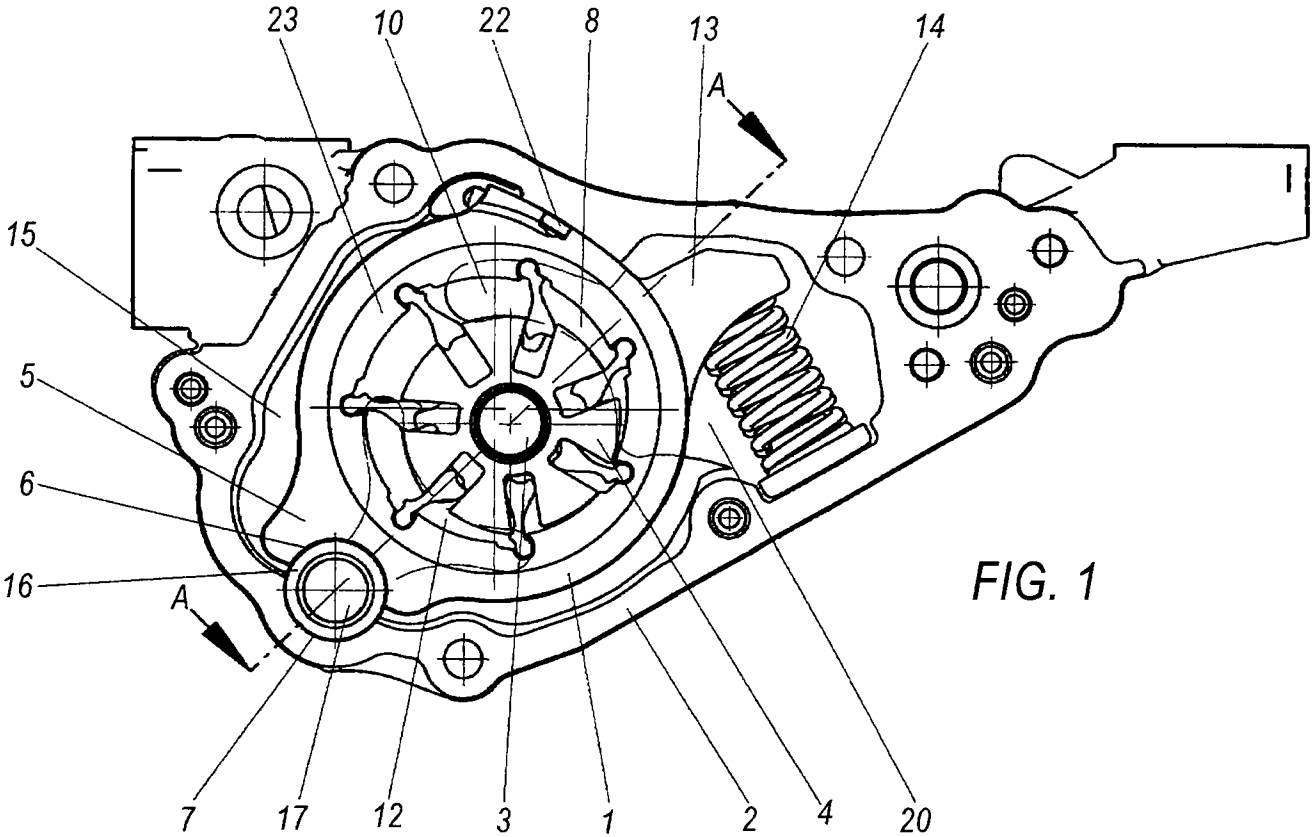
FIG. 1: a flow-controllable cell pump according to the invention in the design of a pendulum slide valve machine with pivotable control slide valve, in lateral view without cover, i.e. without pump housing lid.

Flow-controllable cell pump with pivotable control slide valve.

The invention is therefore based on the object of developing a flow-controllable cell pump with pivotable control slide valve which can also be produced simply, cost effectively in large series with minimum manufacturing and assembly expenditure with minimum space, i.e. also with minimum weight and minimised use of material for slide valve and housing, which additionally operates with substantially less noise compared with the pumps of the prior art, in operation, also minimises the vibrations on the control slide valve caused through pressure pulsations, operates almost free of wear, is robust and not susceptible to malfunctioning, additionally makes possible high pump efficiency and is simultaneously characterized by high stability of the individual assemblies, so that within the scope of the production of the solution according to the invention, control slide valves of plastic material which can be very cost-effectively produced, can be employed.

The flow-controllable cell pump with pivotable control slide valve (1) according to the invention, consisting of a drive shaft (3) mounted in a pump housing (2), an inner rotor (4) arranged on the drive shaft (3), a bearing lug (5) arranged on the control slide valve (1), with a bearing shell (6) arranged in the bearing lug (5), a bearing element arranged in said bearing shell (6), is characterized in that the bearing element is a bearing sleeve (16) with a through-flow opening (17), wherein on both sides of the through-flow opening (17) of the bearing sleeve (16), i.e. a flow-through chamber (19) each is arranged in the pump housing lids (18), or in the pump housing (2) and in the pump housing lid (18) arranged opposite, which is directly connected with the pressure kidney (12) arranged on the same side of the control slide valve (1), but which is sealed against the suction kidney (10) arranged on the suction side through adjacent assemblies.

The invention relates to a flow-controllable cell pump with pivotable control slide valve for liquids, for example for water, for fuels or for oils, more preferably however for the lubricating oil supply of a combustion engine.

FIG. 1 shows a flow-controllable cell pump according to the invention in the design of a pendulum slide valve machine with pivotable control slide valve, in the lateral view without being covered by the pump housing lid. This flow-controllable cell pump with a pivotable control slide valve 1 according to the invention comprises a drive shaft 3 mounted in a pump housing 2 with an inner rotor 4 arranged on this drive shaft 3 and pump chambers 8 arranged between the inner rotor 4 and an outer rotor 23 (as is usual with pendulum slide valve machines).

Mounted on the control slide valve 1 is a bearing lug 5, wherein a bearing shell 6 is arranged in the bearing lug 5.

According to the invention, a special bearing element is arranged in this bearing shell 6. Assigned to this bearing element, a receiving shell 7 which assumes operational connection with the bearing element, i.e. "receives" the bearing element on the/in the pump housing 2 is arranged on the pump housing 2.

On both sides of the pump chambers 8 suction kidneys 10 are arranged in the pump housing 2, which are connected with a suction connection socket 9.

Offset against these suction kidneys 10 by 180° pressure kidneys 12 are arranged in the pump housing 2 likewise on both sides of the pump chambers 8. These pressure kidneys 12 are connected with a pressure connection socket 11. A control slide valve arm 13 is arranged on the control slide valve 1.

Between the pump housing 2 and the control slide valve arm 13 a working spring 14 is arranged which forces the control slide valve into a position of the maximum rate of delivery.

Located opposite on the operating side of the working spring 14, a control pressure chamber 15 is arranged between the pump housing 2 and the control slide valve 1.

Figure 2:
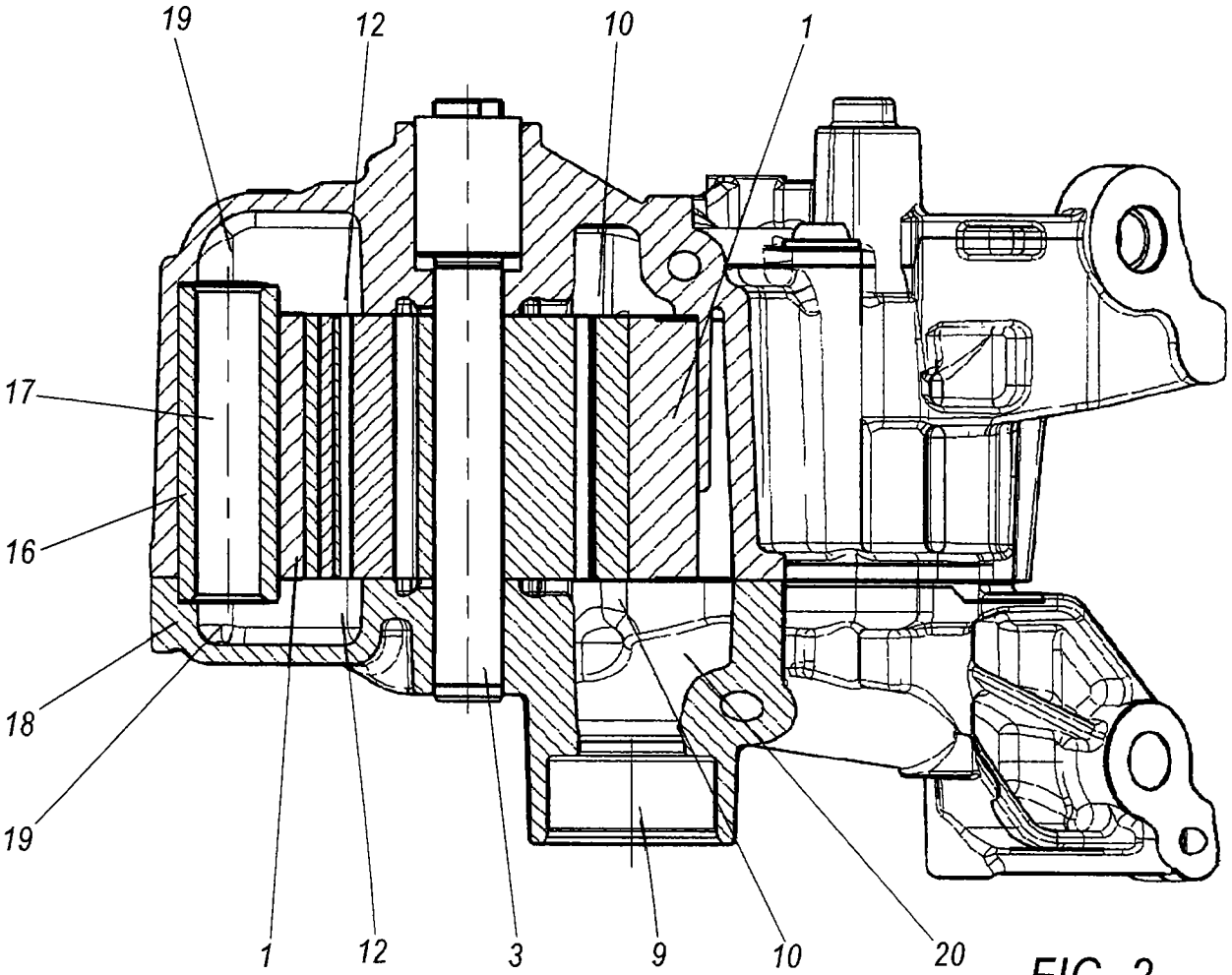
FIG. 2: the flow-controllable cell pump with pivotable control slide valve according to the invention, according to FIG. 1 in section at A-A (in top view)

This control pressure chamber 15 is sealed relative to the inflow channel 20 arranged on the circumference of the control slide valve 1 next to the control pressure chamber 15 with a sealing strip 22, which is guided in a sealing slot arranged in an associated manner on the control slide valve 1. FIG. 2 now shows the flow-controllable cell pump with pivotable control slide valve according to the invention, according to FIG. 1 in top view in the section at A-A.

Figure 3:
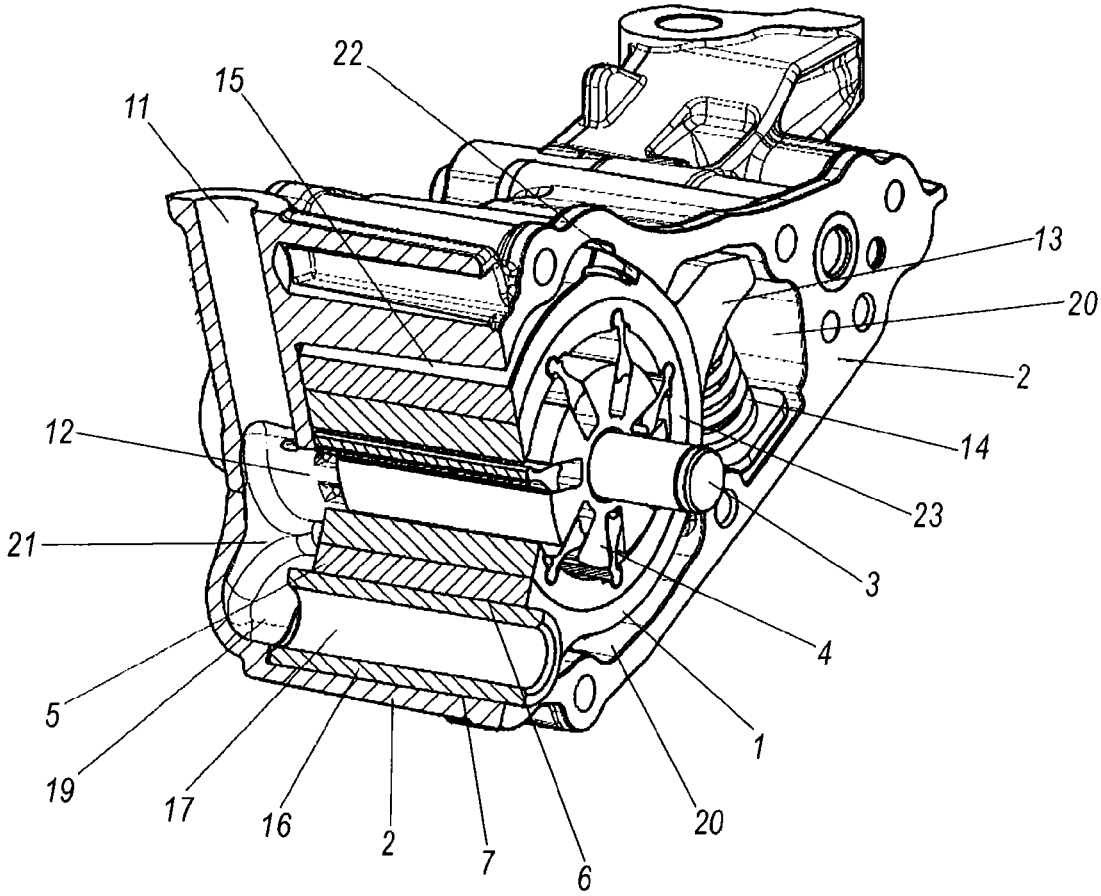
FIG. 3: a three dimensional flow of the flow-controllable cell pump with pivotable control slide valve according to FIG. 1 according to the invention, in part section, without lateral cover.

This flow-controllable cell pump with pivotable control slide valve according to the invention introduced in FIGS. 1 and 2 is now shown three-dimensionally in FIG. 3 in a part section, without the lateral cover.

Figure 4:
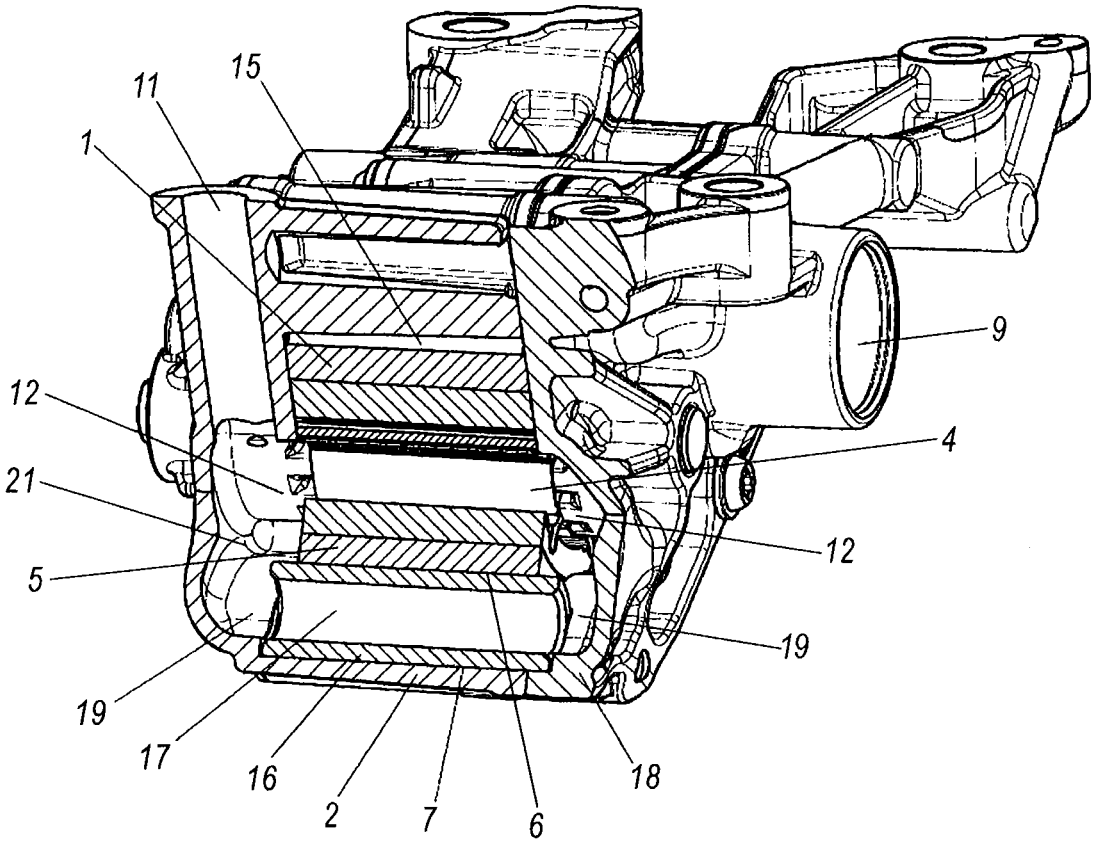
FIG. 4: a three-dimensional view of the flow-controllable cell pump with pivotable control slide valve according to the invention according to FIG. 1, in part section, with lateral cover.

FIG. 4 now shows this flow-controllable cell pump with pivotable control slide valve according to the invention now already shown three-dimensionally in FIG. 3 again in a part section three-dimensionally, but now with a lateral cover, i.e. with a pump housing lid 18.

It is substantial to the invention, as is shown in FIGS. 1 to 4, that the bearing element is a bearing sleeve 16 with a through-flow opening 17, wherein on both sides of the through-flow opening 17 of the bearing sleeve 16, i.e. both in the pump housing 2 as well as in the pump housing lid 18 a flow-through chamber 19 each is arranged.

These flow-through chambers 19 arranged on both sides of the through-flow opening 17 of the bearing sleeve 16 according to the invention are directly connected with the pressure kidney 12 arranged on the respective same side of the control slide valve 1, but are always sealed against the suction side connected with the suction kidneys 10 through adjacent assemblies such as for example the pump housing 2, the control slide valve 1 etc.

In the present design the control pressure chamber 15 is also sealed against the flow-through chamber 19 arranged adjacently.

In conjunction with a "direct control" (via the pump output pressure) the flow-through chambers 19 and/or the outflow channel 21 can also be connected with the control pressure chamber 15.

As is shown in the drawings to the solution according to the invention, the suction connection socket 9 is connected with the suction kidney 10 adjacent to the control slide valve side as well as with the suction kidney 10 located opposite the control slide valve side via inflow channels 20 (here for example below the control slide valve, as well as running in the region of the control slide valve arm 13 and the working spring 14).

Figure 5:
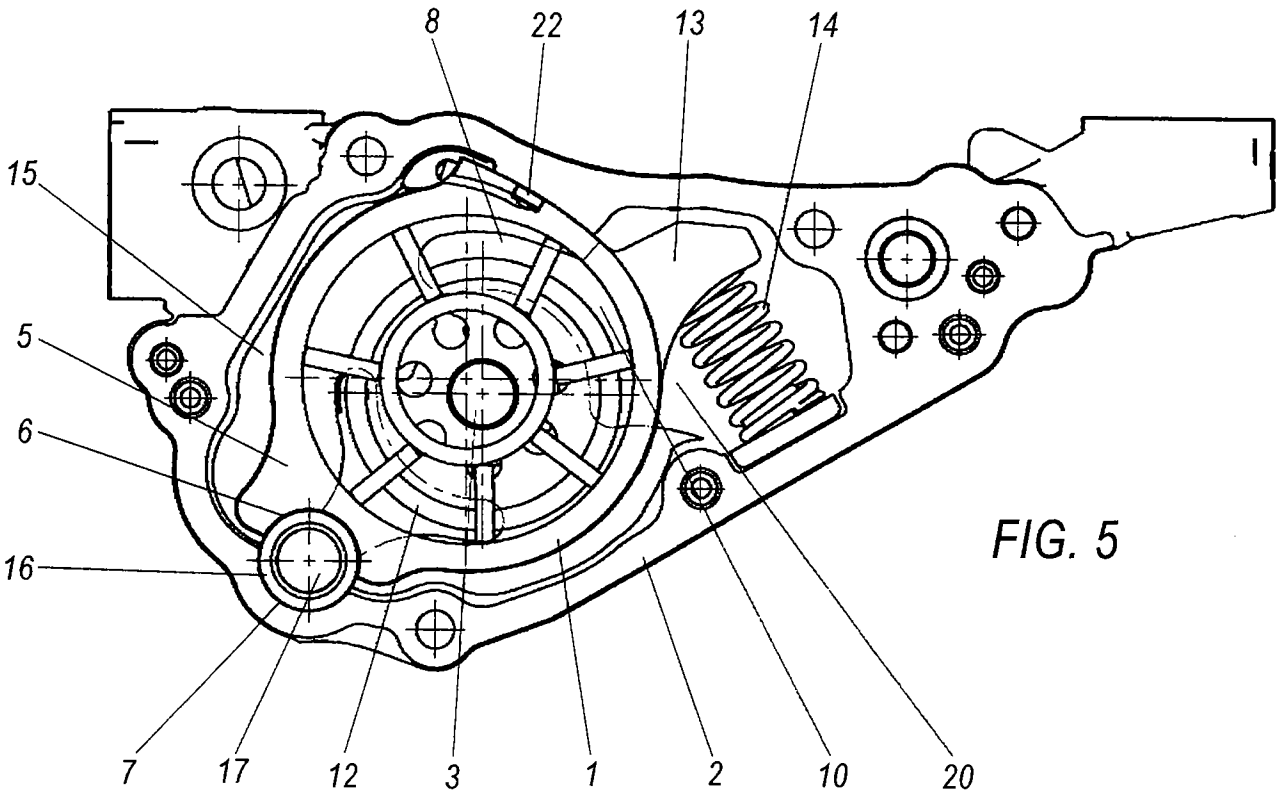
FIG. 5: a flow-controllable cell pump in the design of a vane cell pump with a pivotable control slide valve according to the invention, in the lateral view without cover, i.e. without pump housing lid (similar to the view in FIG. 1).

The pressure connection socket 11 is connected with the pressure kidney 12 adjacent to the control slide valve side and the flow-through chamber 19 adjacent to the control slide valve side via an outflow channel 21. FIG. 5 now shows a flow-controllable cell pump according to the invention in the design of a vane cell pump with pivotable control side valve in the lateral view without pump housing lid.

This flow-controllable vane cell pump with pivotable control slide valve 1 according to the invention likewise has a drive shaft 3 mounted in a pump housing 2 with an inner rotor 4 arranged on said drive shaft 3 and pump chambers 8 arranged between the inner rotor 4 and the control slide valve 1 (as is usual in vane cell pumps equipped with control slide valves 1).

Similar to the design of a cell pump described in conjunction with FIGS. 1 to 4, a bearing lug 5 is arranged on the control slide valve 1, wherein a bearing shell 6 is arranged in the bearing lug 5.

According to the invention, a bearing sleeve 16 as bearing element is also arranged in this bearing shell 6. Assigned to the bearing element/the bearing sleeve 16, a receiving shell 7 which assumes operational connection with the bearing element/the bearing sleeve 16, i.e. "receives" the bearing element/the bearing sleeve 16 on the/in the pump housing, is arranged on the pump housing 2.

On both sides of the pump chambers 8 the suction kidneys 10 which are connected with a suction connection socket 9 are arranged in the pump housing 2.

Offset with respect to these suction kidneys 10 by 180°, the pressure kidneys 12 are arranged in the pump housing 2 likewise on both sides of the pump chambers 8.

These pressure kidneys are connected with a pressure connection socket 11. On the control slide valve 1 a control slide valve arm 13 is arranged.

Between the pump housing 2 and the control slide valve arm 13 a working spring 14 is arranged which forces the control slide valve into a position of maximum rate of delivery.

Located opposite the working spring 14 "on the operating side" a control pressure chamber 15 is arranged between the pump housing 2 and the control slide valve 1.

This control pressure chamber 15 is sealed against the inflow channel 20 arranged adjacently on the circumference of the control slide valve 1 with a sealing strip 22 which is guided in a sealing slot arranged on the control slide valve 1 in an associated manner.

It is characteristic that similar to the representations in FIGS. 1 to 4, even with this cell pump according to the invention in the design of a vane cell pump (shown in FIG. 5) a bearing sleeve 16 with a through-flow opening 17 is again used as bearing element, and that similar to the representations in FIGS. 2, 3 and 4 on both sides of the through-flow opening 17 of the bearing sleeve 16, i.e. both in the pump housing 2 as well as in the pump housing lid 18, a flow-through chamber 19 each is arranged.

These flow-through chamber 19 arranged on both sides of the through-flow opening 17 of the bearing sleeve 16 according to the invention are directly connected with the pressure kidney 12 arranged on the respective same side of the control slide valve 1, but are always sealed against the suction side connected with the suction kidneys 10 by means of adjacent assemblies such as for example the pump housing 2, the control slide valve 1 etc.

In the present design the control pressure chamber 15 is again sealed against the flow-through chamber 19 arranged adjacently.

All solutions presented here bring about that the arrangements according to the invention can be produced in large series, i.e. simply and cost-effectively with minimum manufacturing and assembly expenditure as metal injection or as plastic injection moulding without insertion cores, since with the arrangement according to the invention present here, no connecting channels located in the interior of the pump housing or the pump housing lid and which are therefore expensive (for example by the sand casting method) to produce, are required.

In addition, the solution according to the invention can moreover be produced with minimum space, i.e. also with minimum weight and minimized use of material for slide valve and housing, since according to the effects according to the invention of the control slide valve 1 according to the invention, very little space is required, wherein additionally no connecting channels located in the interior of the pump housing or the pump housing lid which are expensive to produce (for example by the sand casting method), as well as no flow-through opening/connecting channels arranged near the bearing shell/the bearing bolt in the control slide valve are required any longer.

As a result of the omission of the above through-flow opening/connecting channels the arrangement according to the invention brings about a clear reduction of the gap losses, so that the pump efficiency also increases as a result.

At the same time, the sleeve design (of the bearing sleeve 16) according to the invention also brings about an optimal, vibration-damping mounting of the control slide valve 1 on the/in the pump housing 2, so that vibrations on the control slide valve caused in operation more preferably through pressure pulsations can be minimized. Compared with the pumps of the prior art, these flow-controllable cell pumps according to the invention equipped with bearing sleeves 16 dampened the pressure peaks transmitted by the bearing sleeves 16 according to the invention to the pump housing 2 (or the vibrations resulting from the emptying of the individual cells), so that the cell pumps according to the invention additionally operate with substantially less noise. The "large flow cross sections in the interior of the pump" which become possible according to the invention, their optimal arrangement in terms of flow and also their high surface quality that is easily produced additionally bring about a further increase of pump efficiency.

In its entirety, the present arrangement according to the invention furthermore brings about that the flow-controllable cell pumps according to the invention operate almost free of wear, are robust and not susceptible to malfunctioning and are additionally characterized more preferably by high stability of the individual assemblies, so that within the context of the manufacture of the solution according to the invention (for example in conjunction with the use of bearing sleeves with larger outer diameters), even control slide valves of plastic material that can be produced highly cost-effectively, can be employed.

LIST OF REFERENCE NUMBERS

1 Control slide valve
2 Pump housing
3 Drive shaft
4 Inner rotor
5 Bearing lug
6 Bearing shell
7 Receiving shell
8 Pump chamber
9 Suction connection socket
10 Suction kidney
11 Pressure connection socket
12 Pressure kidney
13 Control slide valve arm
14 Working spring
15 Control pressure chambers
16 Bearing sleeve
17 Through-flow opening
18 Pump housing lid
19 Through-flow chamber
20 Inflow channel
21 Outflow channel
22 Sealing strip
23 Outflow chamber

The invention claimed is:

1. A flow-controllable cell pump comprising:
a drive shaft mounted in a pump housing;
an inner rotor configured on the driveshaft;
a bearing lug configured on a control slide valve, such that a bearing shell is configured in the bearing lug;
a bearing element is configured in said bearing shell;
a receiving shell, wherein the bearing element is received in the receiving shell of the pump housing such that the receiving shell is configured to assume an operational connection with at least one of the bearing element, pump chambers configured between the inner rotor and the control slide valve, and wherein an outer rotor is configured in the control slide valve, and suction kidneys arranged on both sides of the pump chambers in the pump housing connected with a suction connection socket; and
at least one pressure kidney is configured on at least one side of the pump chambers in the pump housing such that the at least one pressure kidney is connected with a pressure connection socket, with a control slide valve arm configured on the control slide valve, wherein at least one working spring is configured between the pump housing and the control slide valve arm, such that the control slide valve arm biases the control slide valve into a position of maximum rate of delivery, with at least one control pressure chamber configured between the pump housing and the control slide valve, such that the bearing element is a bearing sleeve with a through-flow opening extending along an axis with opposing first and second ends, wherein at least one flow-through chamber is configured on at least one of the first and the second ends of the through-flow opening configured in at least one of a pump housing and in the pump housing lid, which arranged opposite the pump housing, and wherein the at least one flow-through chamber is directly connected with the at least one pressure kidney, which is configured on the same side of the control slide valve, however the at least one flow-through chamber is sealed against the suction kidney that is configured on a suction side through adjacent assemblies.

2. The flow-controllable cell pump according to claim 1, wherein the at least one flow-through chamber is also sealed against the adjacent control pressure chamber.

3. The flow-controllable cell pump according to claim 1, wherein the suction connection socket is connected via at least one inflow channel with at least one of the suction kidney adjacent to the control slide valve side and the suction kidney located opposite the control slide valve side.

4. The flow-controllable cell pump according to claim 1, wherein the pressure connection socket is connected via outflow channels with at least one of the at least one pressure kidney adjacent to the control slide valve side and the flow-through chamber adjacent to the control slide valve side.

5. The flow-controllable cell pump according to claim 1, wherein the control pressure chamber is sealed against at least one inflow channel adjacent the circumference of the control slide valve with at least one sealing strip guided in at least one sealing slot arranged in an associated manner.

6. The flow-controllable cell pump according to claim 1, wherein upon direct control (via the pump output pressure), at least one of the at least one flow-through chamber and at least one outflow channel is connected with the control pressure chamber.

7. The flow-controllable cell pump according to claim 1, wherein at least one additional flow-through chamber is configured on the other of the at least first and second ends of the through-flow opening.

8. A flow-controllable cell pump comprising:

a drive shaft mounted in a pump housing;

an inner rotor configured on the drive shaft;

a bearing sleeve configured to rotatably connect a control side valve to the pump, wherein the bearing sleeve is received in a receiving shell of the pump housing such that the receiving shell is configured to assume an operational connection with at least one of the bearing sleeve and at least one pump chamber configured between the inner rotor and the control slide valve;

an outer rotor is configured in the control slide valve;

at least one suction kidney is arranged on both sides of the at least one pump chamber in the pump housing connected with a suction connection socket; and at least one pressure kidney is configured on at least one side of the at least on pump chamber, the at least one pressure kidney is connected with a pressure connection socket, with a control slide valve arm configured on the control slide valve;

at least one working spring is configured between the pump housing and the control slide valve arm, wherein the at least one working spring is offset from the control slide valve, such that the at least one working spring biases the control slide valve arm to position the control slide valve at a position of maximum rate of delivery;

at least one control pressure chamber is configured between the pump housing and the control slide valve;

a through-flow opening extends through the bearing sleeve;

at least one flow-through chamber is configured on at least one of a first and a second end of the bearing sleeve, wherein at least one of the first and second ends is configured in at least one of the pump housing and in a pump housing lid, which is arranged opposite the pump housing, and wherein the at least one flow-through chamber is directly connected with the at least one pressure kidney configured on the same side of the control slide valve, however the at least one flow-through chamber is sealed against the at least one suction kidney that is configured on a suction side through adjacent assemblies.

9. The flow-controllable cell pump according to claim 8, wherein the at least one flow-through chambers is also sealed against the adjacent at least one control pressure chamber.

10. The flow-controllable cell pump according to claim 8, wherein the suction connection socket is connected via at least one inflow channel with a suction kidney adjacent to the control slide valve side and a suction kidney located opposite the control slide valve side.

11. The flow-controllable cell pump according to claim 8, wherein the pressure connection socket is connected via outflow channels with at least one of the at least one pressure kidney adjacent to the control slide valve side and the at least one flow-through chamber adjacent to the control slide valve side.

12. The flow-controllable cell pump according to claim 8, wherein the at least one control pressure chamber is sealed against at least one inflow channel adjacent the circumference of the control slide valve with at least one sealing strip guided in at least one sealing slot arranged in an associated manner.

13. The flow-controllable cell pump according to claim 8, wherein upon direct control (via the pump output pressure), at least one of the at least one flow-through chamber and at least one outflow channel is connected with the control pressure chamber.

14. The flow-controllable cell pump according to claim 8, wherein at least one additional flow-through chamber is configured on the other of the at least first end and second end of the bearing sleeve.

* * * * *